US006776103B2

(12) United States Patent
Simard et al.

(10) Patent No.: US 6,776,103 B2
(45) Date of Patent: Aug. 17, 2004

(54) SUPPORT DEVICE WITH LOAD-TRANSFER FUNCTIONALITY FOR SUPPORTING AN INTERMEDIATE PORTION OF AN ELONGATED ELEMENT

(75) Inventors: Marco Simard, Brossard (CA); Georges Bégin, St-Luc (CA)

(73) Assignee: Prochute Securite Inc., Brossard (CA)

( * ) Notice: Subject to any disclaimer, the term of this patent is extended or adjusted under 35 U.S.C. 154(b) by 0 days.

(21) Appl. No.: 10/407,122

(22) Filed: Mar. 25, 2003

(65) Prior Publication Data

US 2003/0183118 A1 Oct. 2, 2003

Related U.S. Application Data

(60) Provisional application No. 60/370,330, filed on Mar. 27, 2002.

(51) Int. Cl.[7] ..... B61B 7/00
(52) U.S. Cl. ..... 104/112
(58) Field of Search ..... 104/87, 112, 113, 104/114, 115, 116, 117, 91

(56) References Cited

U.S. PATENT DOCUMENTS 3,922,972 A * 12/1975 Junes ..... 105/153
4,226,187 A * 10/1980 Paulsen et al. ..... 104/182
4,584,945 A 4/1986 Tupper
6,311,625 B1 * 11/2001 Ostrobrod ..... 104/91
6,412,420 B1 * 7/2002 Kramer et al. ..... 104/182

FOREIGN PATENT DOCUMENTS

GB 2096958 A 10/1982

* cited by examiner

*Primary Examiner*—S. Joseph Morano
*Assistant Examiner*—Robert J. McCarry, Jr.
(74) *Attorney, Agent, or Firm*—Francois Martineau

(57) ABSTRACT

The intermediate support device is used for supporting an intermediate portion of elongated element such as a lifeline. The intermediate support device comprises a frame which is to be fixedly attached to an external structure, and a wheel comprising a hub rotatably carried by the frame and a number of peripherally spaced-apart spokes fixedly attached to and radially extending from the hub, the spokes defining a common first channel side and a common second side opposite the channel side. The frame comprises a frame guard in facing spaced register relative to the spokes first channel side and having an edge portion adjacent the spokes whereby the wheel and the frame guard form a substantially closed loop defining a channel therethrough on the spokes first channel side, for allowing the elongated element to extend through the channel.

15 Claims, 5 Drawing Sheets

SUPPORT DEVICE WITH LOAD-TRANSFER FUNCTIONALITY FOR SUPPORTING AN INTERMEDIATE PORTION OF AN ELONGATED ELEMENT

CROSS-REFERENCE DATA

This patent application claims priority of co-pending U.S. Provisional Patent Application No. 60/370,330 filed Mar. 27, 2002.

FIELD OF THE INVENTION

The present invention relates to a support device with load-transfer functionality for supporting an intermediate portion of an elongated element. According to one particular application, the present invention relates to a lifeline support comprising a lanyard passing device for allowing a lanyard engaged on the lifeline to pass the lifeline support without disengaging the lifeline.

BACKGROUND OF THE INVENTION

Lifelines are frequently used on structures to allow working persons to securely work on the structure far above ground level. These persons may thus walk about the structure in areas where falling off from the structure is not unlikely, while remaining attached to the lifeline to prevent an otherwise dangerous and possibly lethal fall.

A lifeline is a rigid or flexible elongated element such as a rope, chain, rod or the like, that is securely anchored at both its extremities to the fixed structure, which may be a building, bridge, vehicle, or any other structure. For example, known railroad maintenance vehicles are provided with lifelines, to allow working persons to accomplish their railroad maintenance tasks about the vehicle while remaining attached to the vehicle, when these tasks need to be accomplished on railroad bridges or the like areas where little or no safeguards against accidental falling are provided. Indeed, when maintenance of a railroad segment is to be accomplished, it is important, and even compulsory according to many national regulations such as North American regulations, that a work person accomplishing this maintenance be tied to her maintenance vehicle by suitable attachment means at least when person is located between the rails and the free end portions of the railroad ties, to prevent person P from being wounded or killed if she accidentally falls off from the railroad segment.

A person will attach herself to the lifeline by means of a relatively short lanyard which is a link rope or chain. For example, the lanyard can be about one to two meters (three to six feet) long. The lanyard is provided at a first extremity thereof with a harness for attachment to the person's torso, and at a second extremity thereof with a snap hook that is a rigid closed loop having a pivotable segment which is continuously spring-biased into a first closed limit position, but which may yieldingly be forced into a second inwardly opened limit position. Thus, the snap hook may be opened to allow the lifeline to be inserted into the snap hook, and then closed so that the lifeline securely engages and extends through the closed loop snap hook. Consequently, the person wearing the harness becomes securely attached to the lifeline.

Unless the lifeline is very short, in which case it will simply be fixedly anchored at both its extremities to a fixed structure, the lifeline will be supported at regular intervals by means of lifeline support devices between its anchored extremities. Each of these support devices not only vertically supports the lifeline, but also encircles the lifeline in a transversal plane to prevent it from accidental disengagement from the support device. Without intermediate lifeline support devices, the lifeline could significantly sag under its own weight during installation, and it would become very difficult to properly tension the lifeline between its two extremity anchors to maintain it at a generally constant desired height, for example approximately at waist height relative to the surface on which the persons attached to the lifeline will stand.

One problem with conventional intermediate lifeline supports is that they prevent passage of the closed loop snap hook. Indeed, as indicated hereinabove, the intermediate lifeline support encircles the lifeline to ensure that it will not disengage the support at any time. On the other hand, the lanyard snap hook also encircles the lifeline. Thus, when the person using the lanyard moves along the lifeline, with the snap hook sliding along the lifeline, and wants to travel beyond a lifeline intermediate support, she must disengage the snap hook from the lifeline, and then reengage it on the other side of the lifeline support. The period of time during which the snap hook is removed from the lifeline represents a risk-prone situation wherein the person may accidentally fall off the structure without any attachment to the lifeline. Moreover, the snap hook removal and reinstallation operation, short in itself, can become quite time consuming over a long period when lifeline intermediate supports need to be passed repetitively.

A conventional way to circumvent the above-noted danger is to provide two lanyards on each work person. When a person wishes to travel beyond a lifeline support, she can then disengage a first lanyard snap hook from the lifeline, re-attach it on the lifeline on the other side of the lifeline support, disengage the second lanyard snap hook, and re-attach the second lanyard snap hook to the lifeline on the other side of the lifeline support. Thus, at all times is the person attached to the lifeline with at least one lanyard. The problem with this solution is that it is a burdensome and time-consuming procedure for the person working on the structure to have to disengage and re-attach two lanyards snap hooks every time she crosses a lifeline support. In practice, work persons have been known to voluntarily decide to attach a single lanyard to the lifeline, to prevent having to handle two lanyard snap hooks every time a lifeline support is crossed, consequently putting their lives at risk each time they need to travel beyond a lifeline intermediate support.

SUMMARY OF THE INVENTION

The present invention relates to an intermediate support device for supporting an intermediate portion of elongated element, comprising:

a frame, destined to be fixedly attached to a structure; and a wheel comprising a hub rotatably carried by said frame, and a number of peripherally spaced-apart spokes fixedly attached to and radially extending from said hub, said spokes defining a common first channel side and a common second side opposite said channel side; wherein said frame comprises a frame guard in facing spaced register relative to said spokes first channel side and having an edge portion adjacent said spokes whereby said wheel and said frame guard form a substantially closed loop defining a channel therethrough on said spokes first channel side, for allowing the elongated element to extend through said channel.

In one embodiment, said frame guard extends spacedly from said spokes first channel side and between said hub and said spokes, and wherein said channel is consequently defined between said hub, said spokes and said frame guard.

In one embodiment, said spokes define an inner end attached to said hub and an outer free end opposite said inner end, said frame guard comprising a flange at said edge portion thereof, said flange extending closely adjacent to said spokes outer free end on said spokes second side.

In one embodiment, said intermediate support device further comprised a number of peripherally spaced-apart spacers fixedly attached to said wheel so as to extend radially outwardly from said hub, said spacers consequently defining radial clearances between each two peripherally successive spacer, each said radial clearance registering with a corresponding opening defined between two successive spaced-apart said spokes.

In one embodiment, said spacers are spacer rods fixedly attached to said wheel.

In one embodiment, said spacer rods are positioned in a peripherally successively staggered configuration.

In one alternate embodiment, said spacers are formed integrally with said hub and said spokes.

In one embodiment, at least one of said spokes is provided with a corresponding handle bar fixedly attached to and projecting away from the corresponding said spoke on said second side thereof.

In one embodiment, at least a portion of said frame guard main body is removable, whereby access through and egress from the otherwise closed loop formed by said wheel and said frame guard can be achieved for inserting the elongated element in said channel and retrieving the elongated element from said channel.

In one embodiment, said channel forms an angle between 0° and 180°.

The present invention also relates to an intermediate lifeline support for supporting an intermediate portion of a lifeline, comprising:

a frame, destined to be fixedly attached to a structure; and a wheel comprising a hub rotatably carried by said frame, and a number of peripherally spaced-apart spokes fixedly attached to and radially extending from said hub, said spokes defining a common first channel side and a common second side opposite said channel side; wherein said frame comprises a frame guard extending in spaced facing register relative to said spokes first channel side between said hub and said spokes whereby said hub, said spokes and said frame guard form a substantially closed loop defining a lifeline channel therethrough on said spokes first channel side, for allowing the lifeline to extend through said lifeline channel.

The present invention further relates to a lifeline anchoring system comprising:

a lifeline defining a first and a second extremity;

first and second lifeline anchors fixedly attached to said first and second lifeline extremities, for anchoring said first and second lifeline extremities to a structure; and at least one lifeline intermediate support comprising:

a frame, destined to be fixedly attached to a structure; and a wheel comprising a hub rotatably carried by said frame, and a number of peripherally spaced-apart spokes fixedly attached to and radially extending from said hub, said spokes defining a common first channel side and a common second side opposite said channel side;

wherein said frame comprises a frame guard extending in spaced facing register relative to said spokes first channel side between said hub and said spokes whereby said hub, said spokes and said frame guard form a substantially closed loop defining a lifeline channel therethrough on said spokes first channel side, said lifeline extending through said lifeline channel.

DETAILED DESCRIPTION OF THE EMBODIMENTS

Figure 1:
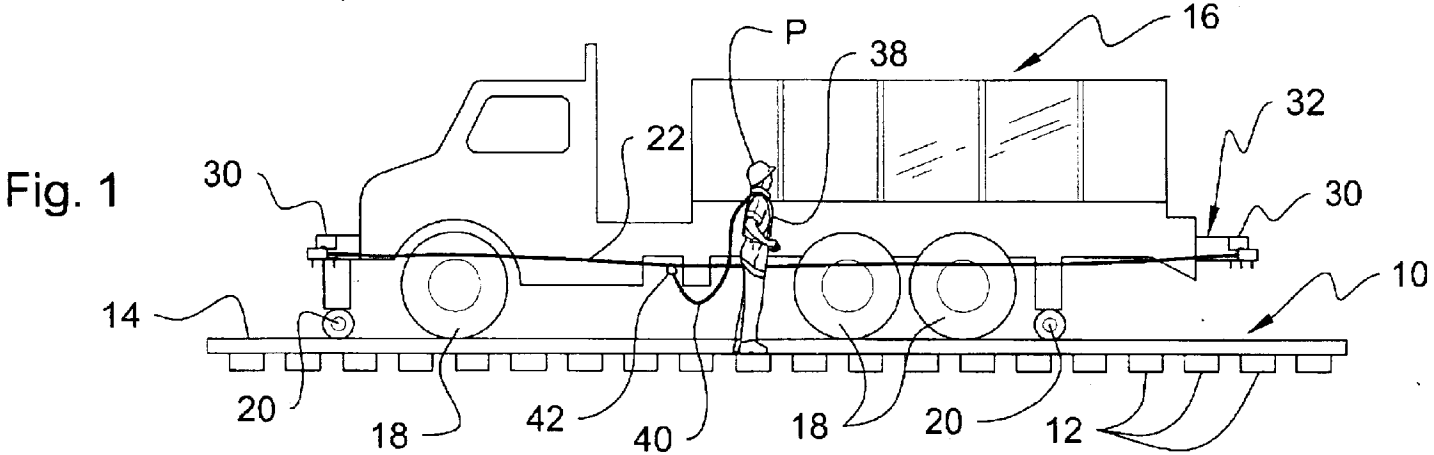
FIGS. 1 and 2 are a side elevation and a top plan view, respectively, of a railroad maintenance vehicle located on a railroad segment, with a work person standing next to the vehicle on the railroad segment and being attached to a lifeline provided on the vehicle, and with the vehicle being provided with four lifeline intermediate supports according to a first embodiment of the present invention.
Figure 2:
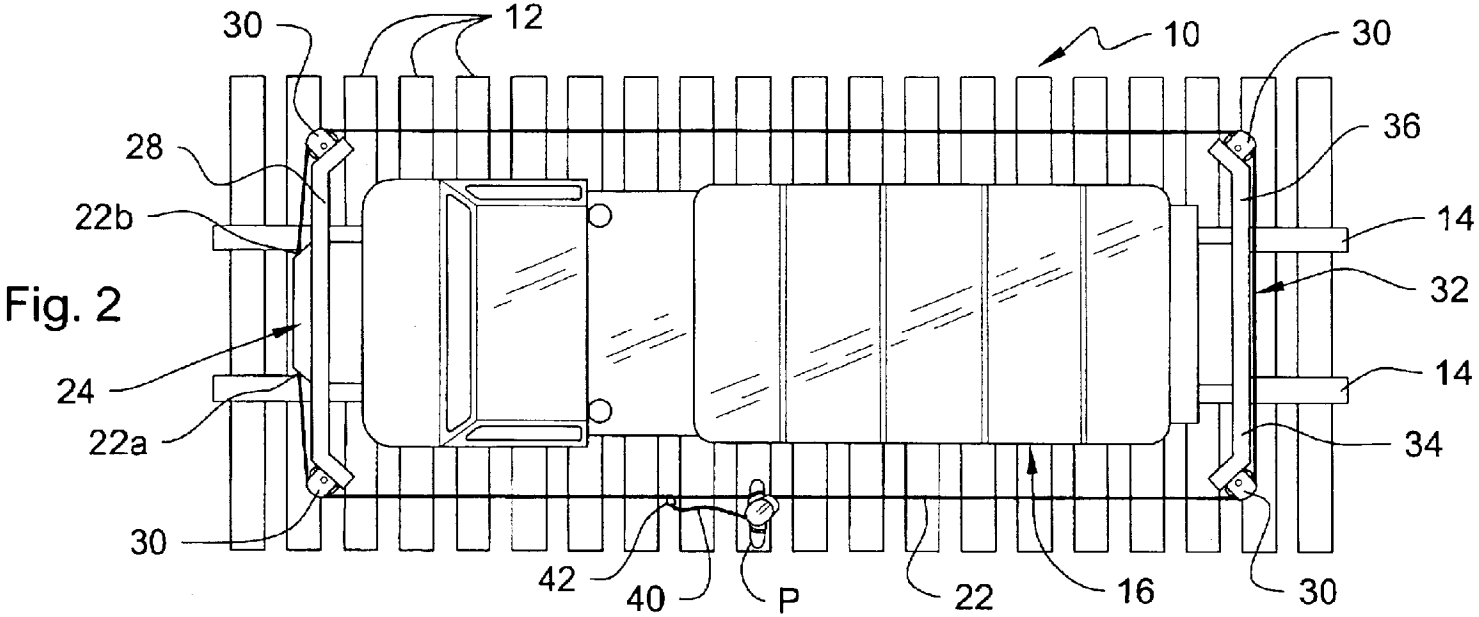

FIGS. 1 and 2 show a railroad segment 10 comprising a number of transverse ties 12 supporting a pair of rails 14. Railroad segment 10 extends over a chasm or river, and is consequently supported spacedly over ground by means of a bridge structure of an appropriate type (note shown).

A railroad maintenance vehicle 16 is movable along railroad segment 10. Vehicle 16 has a hybrid transporting means in the form of conventional road wheels 18 and railroad guide wheels 20. The conventional road wheels 18 are spaced in such a way that they allow vehicle 10 to move on a conventional road and also to engage the top surface of rails 14, providing the traction or propulsion means of the vehicle. The railroad guide wheels 20 each have a peripheral groove that engages a corresponding rail 14 in such a way as to guide vehicle 16 along railroad segment 10 and maintain road wheels 18 engaged on rails 16. Vehicle 16, as briefly described hereinabove, is of known construction.

An elongated lifeline 22 is provided around vehicle 16. Lifeline 22 is illustrated as being flexible (e.g. a rope) as suggested by its slight sagging, but it is understood that it could alternately be rigid (e.g. a series of interconnected). Lifeline 22 is fixedly attached at both its extremities 22*a*, 22*b* to a front lifeline support structure 24 that is carried by vehicle 16. Front lifeline support structure 24 comprises a pair of sidewardly extending arms 26, 28 that each support a corresponding lifeline intermediate support 30, 30 according to a first embodiment of the present invention. A rear lifeline support structure 32 is further carried at the rear end of vehicle 16. Rear lifeline support structure 32 also comprises a pair of sidewardly extending arms 34, 36 that each support a corresponding lifeline intermediate support 30, 30 according to the first embodiment of the present invention. Each lifeline intermediate support 30 supports lifeline 22 spacedly over ground between its two extremities 22*a*, 22*b*. As shown in FIGS. 1–5, intermediate support 30 also allows a 90° change of direction of lifeline 22. Lifeline 22 consequently extends around substantially the whole vehicle 16 approximately at waist height relative to the level of ties 12.

FIGS. 1 and 2 further show that person P is equipped with a harness 38 of known construction. Harness 38 is worn by person P and attached to the first extremity of a lanyard 40. The second extremity of lanyard 40 is equipped with suitable lifeline engagement means that allow the lanyard to be slidingly attached to lifeline 22. A closed loop snap hook 42 is shown in the annexed drawings as the lifeline engagement means. Snap hook 42 has the advantage of being selectively removable from lifeline 22. As person P travels around vehicle 16, including close to the outer free end of ties 12, she can remain attached to lifeline 22 at all times by means of lanyard 40 and snap hook 42. As she moves along lifeline 22, snap hook 42 will slide along lifeline 22, consequently not hampering the displacement of person P.

Figure 3A:
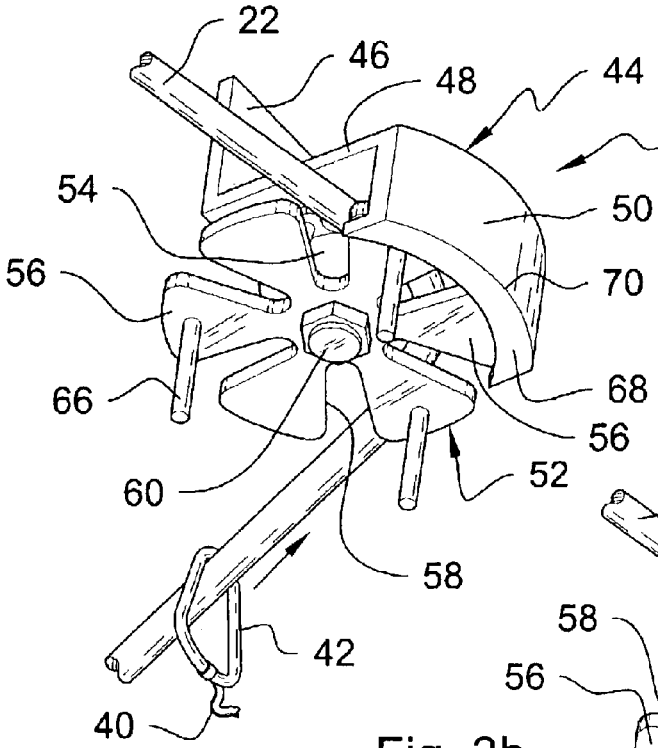
FIGS. 3*a*, 3*b* and 3*c* are bottom perspective views of a lifeline intermediate support according to the first embodiment of the present invention, sequentially showing the passage of a snap hook and its partly shown lanyard from one side of the lifeline intermediate support to the other without disengagement from the lifeline, with FIG. 3*b* being partly broken to more clearly show the snap hook engaged in an opening between two wheel spokes.
Figure 3B:
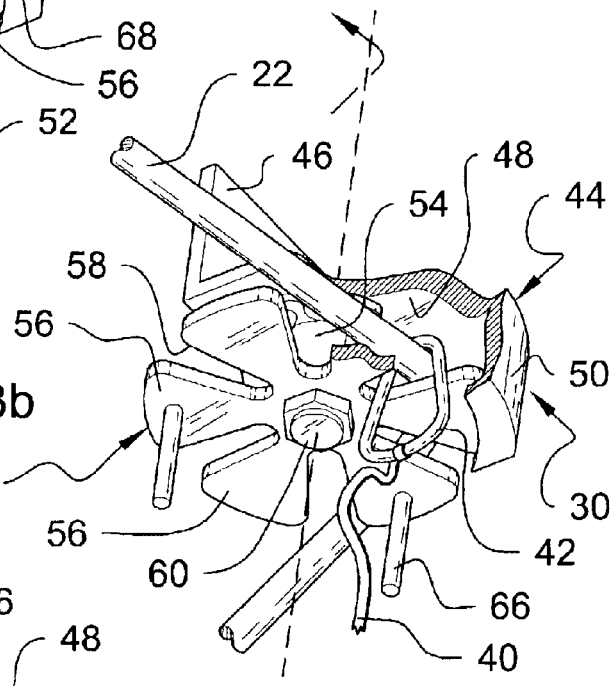
Figure 3C:
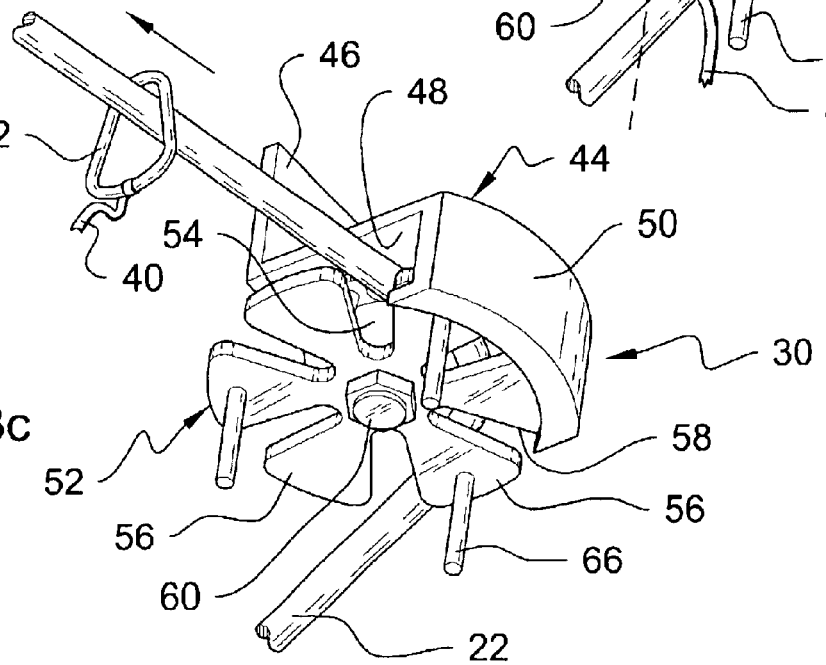
Figure 4:
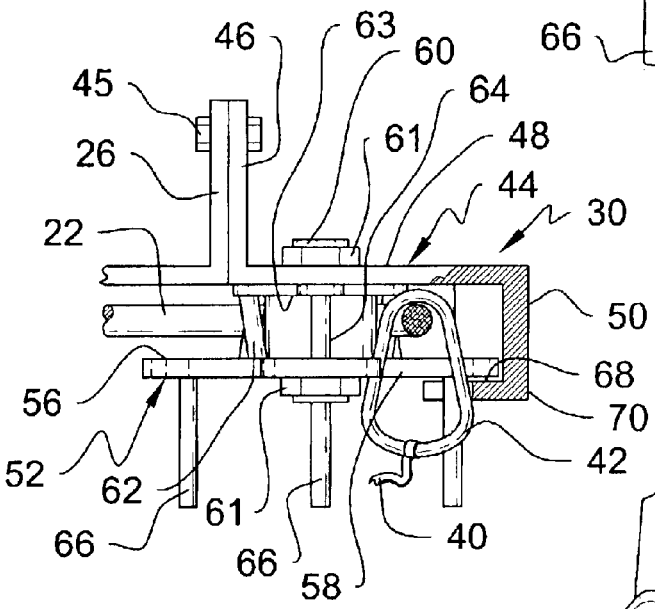
FIG. 4 is a side elevation, partly in cross-section, of the lifeline intermediate support of the first embodiment of the present invention, together with a lifeline engaged by a snap hook attached to a partly shown lanyard, and further showing part of a structure to which the lifeline intermediate support is fixed.

FIGS. 3*a*, 3*b*, 3*c*, 4 and 5 more particularly show the lifeline intermediate support 30 according to the first embodiment of the present invention. Lifeline intermediate support 30 comprises a frame 44 that is attached to a corresponding one of arms 26, 28, 34, 36 (for example to arm 26 as shown in FIG. 4) by means of suitable frame attachment means such as bolts 45 (as shown in FIG. 4), or alternately by welding, with screws, or any other type of attachment element allowing the fixed attachment of frame 44 to its corresponding arm 26, 28, 34, 36.

Frame 44 comprises a first flat vertical attachment wall 46 that is destined to flatly engage a corresponding arm 26, 28, 34, 36, a second flat horizontal wall 48 that extends perpendicularly from attachment wall 46, and a third vertical arcuate side wall 50 that downwardly depends from horizontal wall 48 opposite attachment wall 46.

A wheel 52 is rotatably carried by frame 44. Wheel 52 comprises a hub 54 and a number of peripherally spaced-apart spokes 56 fixedly attached to and radially extending from the bottom portion of hub 54. Spokes 56 define a common first channel side on their upper surface, and a common second side opposite said channel side on their bottom surface. Spokes 56 define an inner end attached to hub 54 and an outer free end opposite their inner end. Spokes 56 have an outwardly divergent shape, although it is understood that spokes 56 could have any other suitable shape. Openings 58 are defined between each two peripherally successive spokes 56.

Hub 54 is rotatably mounted on a shaft 60 that extends through hub 54 and through the frame horizontal wall 48, with nuts 61 being provided at both of the shaft's threaded extremities on either side of the wheel 52 and frame 44 assembly to retain wheel 52 in rotatable attached engagement with frame 44.

Figure 5:
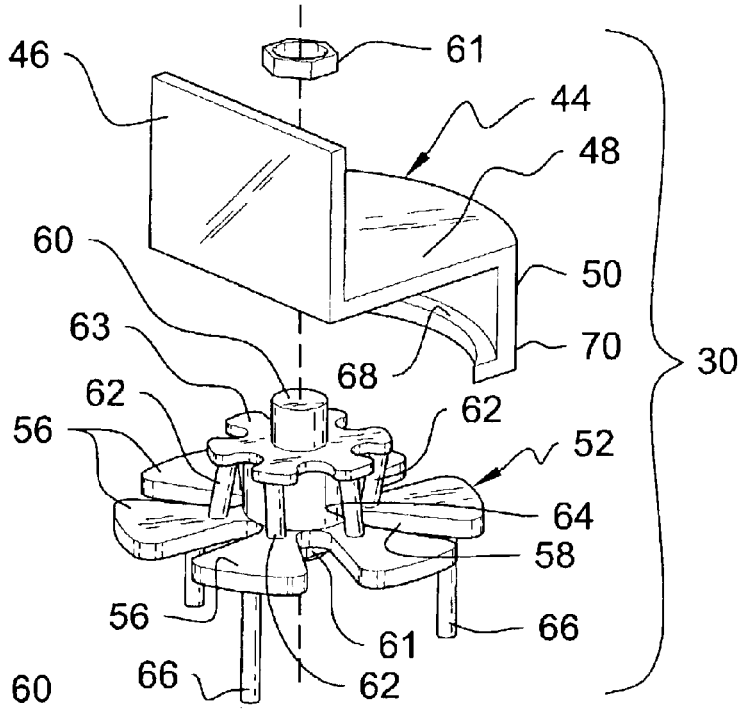
FIG. 5 is an exploded perspective view of the lifeline intermediate support of the first embodiment of the invention.

A number of peripherally spaced-apart spacers are fixedly attached to wheel 52. As shown in FIGS. 4 and 5, the spacers of the first embodiment of the invention are more particularly a number of spacer rods 62 fixedly attached to wheel 52. Each spacer rod 62 extends in an inclined fashion between a corresponding spoke 56 and a ring member 63 integrally attached to hub 54, so that spacer rods 62 are collectively arranged in a peripherally successively staggered configuration. Each spacer rod 62 is located above a corresponding spoke 56, and consequently a radial clearance 64 is defined between each two peripherally successive spacer rods 62 that registers with an underlying corresponding opening 58.

Wheel 52 is further provided with a number handle bars 66, for example three handle bars 66 as shown in the drawings, that are each fixedly attached to and depend downwardly from the bottom surface of a spoke 56.

The lateral wall 50 of frame 44 extends downwardly slightly beyond the outer free end of spokes 56, and is provided with a radially inturned flange 68 at a bottom edge portion 70 of lateral wall 50. Flange 68 consequently projects radially inwardly under the outer free end of spokes 56, closely adjacent thereto.

Lifeline 22 extends through a lifeline channel defined by a substantially closed loop formed by the frame lateral wall 50, a portion of the frame horizontal wall 48, hub 54 and spokes 56. The loop does not need to be entirely closed, as long as lifeline 22 will be prevented from accidental egress from this closed loop in use. In the embodiment shown in FIGS. 3*a*, 3*b*, 3*c*, 4 and 5, a play exists in this substantially closed loop, between the spokes outer free end and lateral wall 50, but this play, which prevents friction between spokes 56 and lateral wall 50 during rotation of wheel 52, is smaller than the lifeline diameter. Consequently, the lifeline channel is said to be formed by a "substantially" closed loop.

Frame 44 defines a frame guard which is the portion of frame 44 forming the above-mentioned lifeline channel. The frame guard of frame 44 is consequently in facing spaced register with the top surface of spokes 56. In the embodiment shown in FIGS. 3*a*, 3*b*, 3*c*, 4 and 5, the frame guard of frame 44 would be constituted by lateral wall 50 and by the portion of horizontal wall 48 that is located between hub 54 and lateral wall 50. The frame edge portion 70 is defined as the portion of frame 44 that is closely adjacent to spokes 56 in use.

In use, lifeline 22 is supported between its two anchored extremities 22*a*, 22*b* by means of a number of intermediate lifeline supports 30, for example four intermediate lifeline supports 30 as shown in FIGS. 1 and 2. More particularly, lifeline 22 is supported spacedly over ground by one or more spokes 26 that are located underneath the lifeline channel of each intermediate lifeline support 30, and is encircled within the lifeline channel by the substantially closed loop formed by spokes 56, hub 54 and frame walls 48, 50.

As sequentially shown in FIGS. 3*a*, 3*b* and 3*c*, snap hook 42 attaching lanyard 40 to lifeline 22 can slide along lifeline 22 and pass beyond lifeline intermediate support 30 without disengaging lifeline 22. More particularly, snap hook 42 will slide along lifeline 22 towards lifeline intermediate support 30 (FIG. 3*a*), until it engages an opening 58 between two successive spokes 56. Wheel 52 may then be forcibly rotated by person P, either by pulling on lanyard 40 and on snap hook 42 or by pushing on a handle bar 66, to continue to slide snap hook 42 along lifeline 22 through the lifeline channel (FIG. 3*b*), with lanyard 40 sagging underneath the frame side wall 50, until snap hook 42 is carried beyond the frame side wall 50. Snap hook 42 then continues to slide along lifeline 22 as it exits its opening 58, and moves away from lifeline intermediate support (FIG. 3*c*).

It can thus be seen that lifeline 22 will remain supported by wheel 52 at all times, and that the closed loop forming the lifeline channel will prevent accidental egress of lifeline 22 from the lifeline channel. Furthermore, should an important load be applied on lifeline 22, for example if a person falls and hangs from lifeline 22 by means of his lanyard 40, the loaded lifeline 22 will become partly supported by the front support structure 24 to which lifeline 22 is anchored, and partly by the spokes 56 of the adjacent lifeline support 30 (or the two adjacent lifeline supports if the load is applied between two supports 30). Lifeline 22 will be prevented from laterally sliding off spokes 56 by the frame side wall 50. Furthermore, the frame flange 68 will help prevent wheel 52 from yieldingly deforming or from tilting under the load downwardly applied on spokes 56 by lifeline 22.

Spacer rods 62 allow lifeline 22 to remain spaced from the wheel hub 54 proper at all times. When snap hook 42 engages an opening 58 between two successive spokes 56, its segment located between lifeline 22 and wheel hub 54 will engage a radial clearance 64 between two successive spacer rods 62 (FIG. 4). Thus, spacer rods 62 prevent snap hook 42 from being squeezed between wheel hub 54 and lifeline 22, which could hamper rotation of wheel 52 when engaged by snap hook 42 due to the friction that would exist between snap hook 42, wheel hub 54 and lifeline 22. Furthermore, the peripherally successively staggered configuration of spacer rods 62 will naturally bias lifeline 22 towards an advantageously vertically centered position between the wheel spokes 56 and the frame horizontal wall 48 when no load (other than the lifeline's own weight) is applied on lifeline 22, as shown in FIG. 4.

Figure 6:
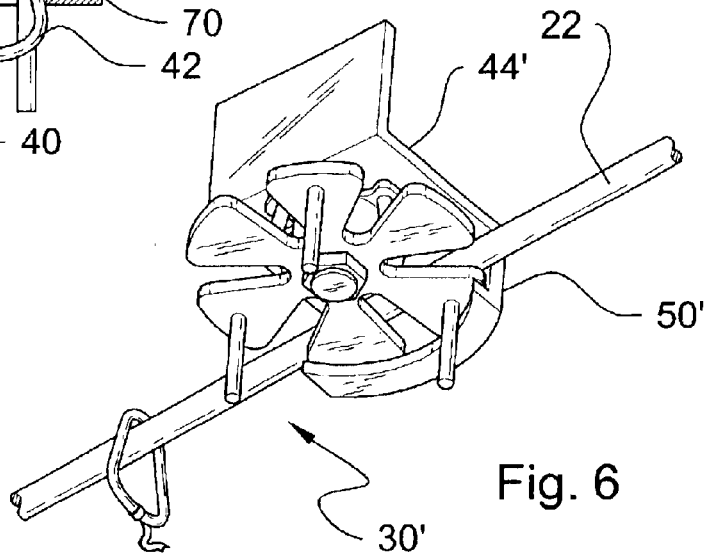
FIG. 6 is a bottom perspective view of a second embodiment of a lifeline intermediate support according to the present invention, together with a lifeline engaged by a snap book attached to a partly shown lanyard.
Figure 7:
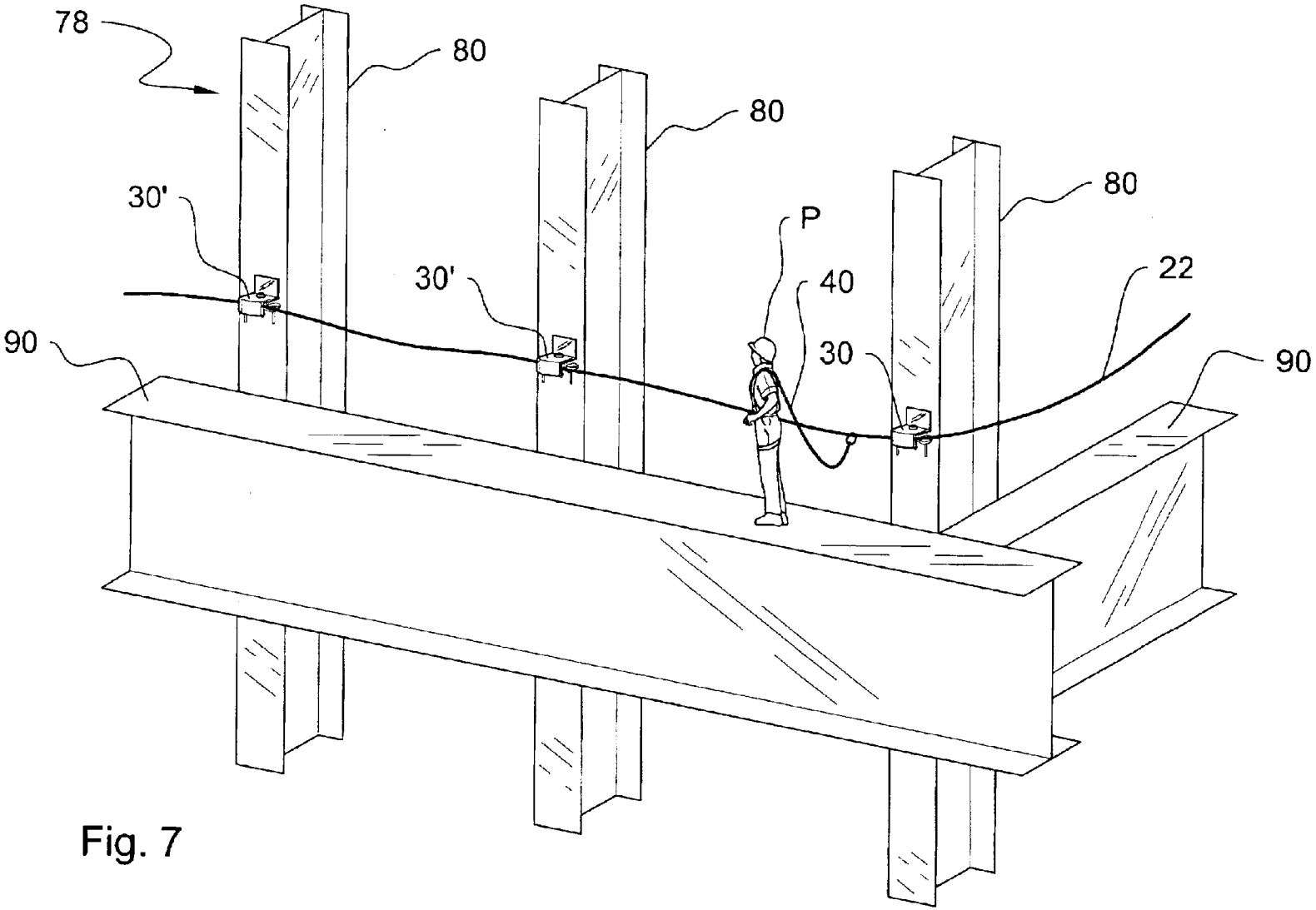
FIG. 7 is a perspective view of a structure provided with two lifeline intermediate supports according to the second embodiment of the invention and with one lifeline intermediate support according to the first embodiment of the invention, and showing a lifeline supported by the lifeline intermediate supports and a person attached to the lifeline.

FIG. 6 shows an alternate embodiment of a lifeline intermediate support 30' which is similar to the first embodiment of FIGS. 1–5, with the exception that lifeline intermediate support 30' is destined to be positioned where there is no change of direction of lifeline 22, as shown in FIG. 7. Consequently, the configuration of frame 44' is slightly modified, with side wall 50' being shorter (FIG. 6). FIG. 7 shows a vertically raised structure 78, such as a bridge or building structure, that includes vertical posts 80 and horizontal struts 90 on which a person P working on structure 78 may walk. A lifeline 22 is provided spacedly over struts 90, to allow person P to remain attached thereto by means of a lanyard 40. A corner lifeline intermediate support 30 according to the first embodiment of the invention, is provided where lifeline 22 changes direction, and straight lifeline intermediate supports 30' according to the second embodiment of the invention, are provided where lifeline 22 is supported without any change in direction. Anchors (not shown) are of course provided at the extremities (not shown in FIG. 7) of lifeline 22.

Figure 8:
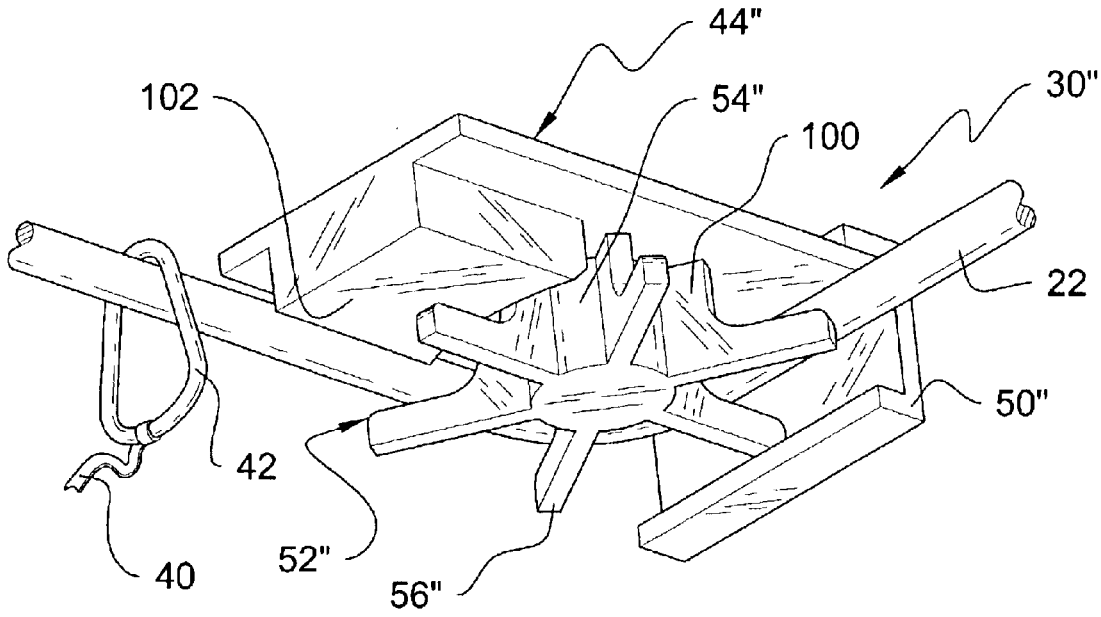
FIGS. 8 and 9 are a bottom perspective view and a side elevation, respectively, of a third embodiment of a lifeline intermediate support according to the present invention, and further showing a lifeline engaging the lifeline intermediate support and a snap hook attached to the lifeline and provided with a partly shown lanyard.
Figure 9:
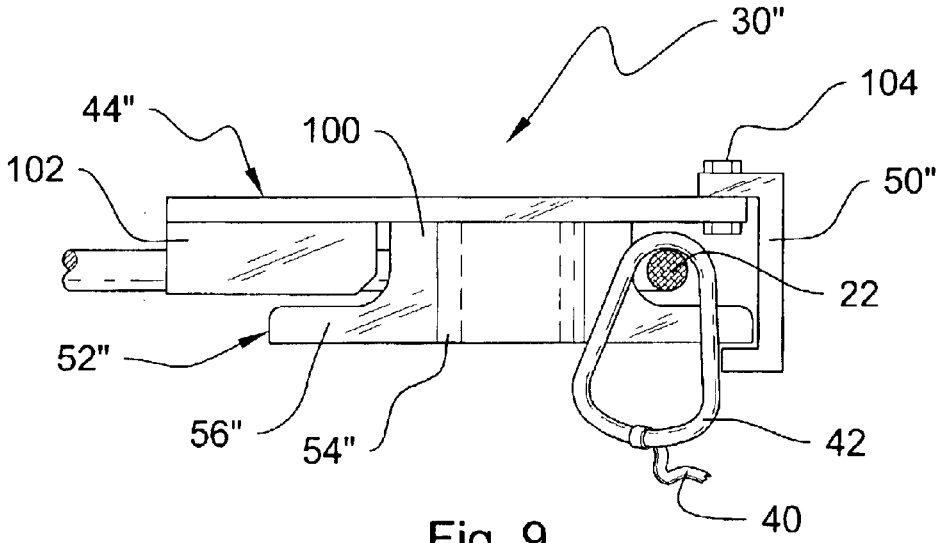

FIGS. 8 and 9 show a third embodiment of a lifeline intermediate support 30" which is similar to the first embodiment 30, except for the following features which differ.

The wheel 52" comprises spokes 56" that are of a thinner configuration than the spokes 56 of the first embodiment. The spacers 100 are formed integrally with spokes 56" and the wheel hub 54".

Also, frame 44" comprises a reinforcement block 102 that helps prevent wheel 52" from tilting under an important load applied by lifeline 22, such as if a work person falls and hangs from lifeline 22. Indeed, the spoke or spokes 56" located on the opposite side of lifeline 22 relative to the wheel central axis, would tilt upwardly under a downward load being applied by lifeline 22, which would result in the spoke or spokes 56" located under reinforcement block 102 upwardly abutting against reinforcement block 102.

Frame 44" further comprises a removable side wall 50", the latter being attachable to the remaining portion of frame 44" by means of bolts 104. This allows easier access into or egress from the otherwise closed loop lifeline channel, to insert or remove a lifeline therefrom without having to free one of the lifeline's extremities from its anchor.

It is understood that the particular embodiments of the invention shown in the annexed drawings and described in the present specification, can be modified within the scope of the appended claims, and as will be obvious for someone skilled in the art. For example, the lifeline support could be used on any type of structure, and could consequently have different configurations and shapes. It could be oriented differently, for example with the rotatable wheel 52 being vertical.

Also the lifeline channel has been shown as being straight in the second embodiment of FIG. 6, and as forming an angle of 90° in the first embodiment of FIGS. 3*a*, 3*b*, 3*c*, 4 and 5. It is understood, however, that the angle formed by the lifeline channel could be anywhere between 0° and 180° (where a 0° angle means that the channel is straight). The lifeline channel does not need to be encircled at all points with both wheel 52 and the frame guard of frame 44; frame guard 44 could for example be formed of a single, relatively thin rod, while the channel would still make a 90° angle by running along and over spokes 56.

We claim:

1. An intermediate support device for supporting an intermediate portion of an elongated element, comprising:

a frame, for fixed attachment to a structure; and a wheel comprising a hub rotatably carried by said frame, and a number of peripherally spaced-apart spokes fixedly attached to and radially extending from said hub, said spokes defining a common first channel side and a common second side opposite said channel side;

wherein said support device further comprises a number of peripherally spaced-apart radial spacers fixedly attached to said wheel and each extending radially outwardly from said hub, said radial spacers consequently defining radial clearances between each two peripherally successive spacers, each said radial clearance registering with a corresponding opening defined between two successive spaced-apart said spokes, said radial spacers for to radially spacing the elongated element from said hub for allowing a snap hook device engaging the elongated element to loosely fit in a radial clearance between the elongated element and said hub.

2. An intermediate support device as defined in claim 1, wherein said frame comprises a frame guard in facing spaced register relative to said spokes first channel side and having an edge portion adjacent said spokes whereby said wheel and said frame guard from a substantially closed loop defining a channel therethrough on said spokes first channel side, for allowing the elongated element to extend through said channel, said frame guard extending spacedly from said spokes first channel side and between said hub and said spokes, and wherein said channel is consequently declined between said hub, said spokes and said frame guard.

3. An intermediate support device as defined in claim 2, wherein said spokes define an inner end attached to said hub and an outer free end opposite said inner end, said frame guard comprising a flange at said edge portion thereof, said flange extending closely adjacent to said spokes outer free end on said spokes second side.

4. An intermediate support device as defined in claim 2, wherein said spacers are spacer rods fixedly attached to said wheel.

5. An intermediate support device as defined in claim 4, wherein said spacer rods are positioned in a peripherally successively staggered configuration.

6. An intermediate support device as defined in claim 2, wherein said spacers are formed integrally with said hub and said spokes.

7. An intermediate support device as defined in claim 2, wherein at least one of said spokes is provided with a corresponding handle bar fixedly attached to and projecting away from the corresponding said spoke on said second side thereof.

8. An intermediate support device as defined in claim 2, wherein at least a portion of said frame guard main body is removable, whereby access through and egress from the otherwise closed loop formed by said wheel and said frame guard can be achieved for inserting the elongated element in said channel and retrieving the elongated element from said channel.

9. An intermediate support device as defined in claim 2, wherein said channel forms an angle between 0° and 180°.

10. An intermediate lifeline support for supporting an intermediate portion of a lifeline, comprising:

a frame for fixed attachment to a structure; and a wheel comprising a hub rotatably carried by said frame, and a number of peripherally spaced-apart spokes fixedly attached to and radially extending from said hub, said spokes defining a common first channel side and a common second side opposite said channel side;

wherein said frame comprises a frame guard extending in spaced facing register relative to said spokes first channel side between said hub and said spokes whereby said hub, said spokes and said frame guard form a substantially closed loop defining a lifeline channel therethrough on said spokes first channel side, for allowing the lifeline to extend through said lifeline channel; and wherein said lifeline support further comprises a number of peripherally spaced-apart radial spacers fixedly attached to said wheel and each extending radially outwardly from said hub, said radial spacers consequently defining radial clearances between each two peripherally successive spacer, each said radial clearance registering with a corresponding opening defined between two successive spaced-apart spokes, said radial spacers allow the lifeline to radially abut thereon spacedly from said hub for allowing a snap hook device engaging the lifeline to loosely fit in a radial clearance between the lifeline and said hub.

11. An intermediate lifeline support as defined in claim 10, wherein said spokes define an inner end attached to said hub and an outer free end opposite said inner end, said frame guard comprising a flange at said edge portion thereof, said flange extending closely adjacent to said spokes outer free end on said spokes second side.

12. An intermediate lifeline support as defined in claim 10, wherein at least one of said spokes is provided with a corresponding handle bar fixedly attached to and projecting away from the corresponding said spoke on said second side thereof.

13. An intermediate lifeline support as defined in claim 10, wherein at least a portion of said frame guard main body is removable, whereby access through the otherwise closed loop formed by said wheel and said frame guard can be achieved for inserting or retrieving a lifeline in said lifeline channel.

14. An intermediate support device as defined in claim 10, wherein said channel forms an angle between 0° and 180°.

15. A lifeline anchoring system comprising:

a lifeline defining a first and a second extremity, first and second lifeline anchors fixedly attached to said first and second lifeline extremities, for anchoring said first and second lifeline extremities to a structure; and at least one intermediate lifeline support comprising:

a frame, for fixed attachment to a structure; and a wheel comprising a hub rotatably carried by said frame, and a number of peripherally spaced-apart spokes fixedly attached to and radially extending from said hub, said spokes defining a common first channel side and a common second side opposite said channel side;

wherein said frame comprises a frame guard extending in spaced facing register relative to said spokes first channel side between said hub and said spokes whereby said hub, said spokes and said frame guard form a substantially closed loop defining a lifeline channel therethrough on said spokes first channel side said lifeline extending through said lifeline channel; and wherein said lifeline support further comprises a number peripherally spaced-apart radial spacers fixedly attached to said wheel and each extending radially outwardly from said hub, said radial spacers consequently defining radial clearances between each two peripherally successive spacer, each said radial clearance registering with a corresponding opening defined between two successive spaced-apart said spokes said radial spacers allowing said lifeline to radially abut thereon spacedly from said hub for allowing a snap hook device engaging said lifeline to loosely fit in a radial clearance between said lifeline and said hub.

* * * * *